United States Patent [19]

Akashi

[11] 4,223,425

[45] Sep. 23, 1980

[54] SLIDE FASTENER

[75] Inventor: Shunji Akashi, Kurobe, Japan

[73] Assignee: Yoshida Kogyo K.K., Tokyo, Japan

[21] Appl. No.: 9,171

[22] Filed: Feb. 2, 1979

[30] Foreign Application Priority Data

Feb. 21, 1978 [JP] Japan ..... 53-20982[U]

[51] Int. Cl.[2] ..... A44B 19/36

[52] U.S. Cl. ..... 24/205.11 R; 24/205.11 F

[58] Field of Search ..... 24/205.11 R, 205.11 F

[56] References Cited

U.S. PATENT DOCUMENTS

| | | | |
|---|---|---|---|
| 2,332,923 | 10/1943 | Lohse | 24/205.11 R |
| 3,086,269 | 4/1963 | Taylor | 24/205.11 R |
| 3,309,746 | 3/1967 | Carlile | 24/205.11 R |
| 3,905,073 | 9/1975 | Fukuroi | 24/205.11 R |
| 3,906,594 | 9/1975 | Takahashi et al. | 24/205.11 F |
| 3,951,715 | 4/1976 | Hofius | 24/205.11 F X |
| 4,045,845 | 9/1977 | Kando | 24/205.11 F |
| 4,155,147 | 5/1979 | Akashi | 24/205.11 F |

FOREIGN PATENT DOCUMENTS

| | | | |
|---|---|---|---|
| 599440 | 7/1973 | Switzerland | 24/205.11 F |

*Primary Examiner*—Roy D. Frazier
*Assistant Examiner*—Peter A. Aschenbrenner
*Attorney, Agent, or Firm*—Robert E. Burns; Emmanuel J. Lobato; Bruce L. Adams

[57] ABSTRACT

An open end type of slide fastener has an end stop comprising a pair of lugs formed from a plastic material and secured to the longitudinal edges of respective stringer tapes, each lug having an oblique inner edge extending divergently with respect to the longitudinal axis of the fastener such that the lugs define therebetween a substantially V-shaped opening complementary in shape with the diamond of a slider. One of the pair of lugs has at least one projection continuous to the oblique inner edge and the other lug has a recess receiving the projection. The projection extends transversely beyond the central longitudinal axis of rows of interengaged fastener elements and is disposed for abutting engagement with the slider diamond. When the diamond moves past the projection and spreads the lugs apart, the uppermost opposed coupling elements become disengaged to allow smooth movement of the diamond therebetween.

3 Claims, 7 Drawing Figures

SLIDE FASTENER

BACKGROUND OF THE INVENTION

1. Field of the Invention:

This invention relates to a slide fastener and more particularly to an end stop device adapted for use on an open end type of fastener.

2. Prior Art:

There have been proposed many open end type slide fasteners. A common drawback of such fasteners is found in that when the fastener is fully closed, the opposed fastener tapes tend to flare up at their respective upper ends owing to what is commonly termed the "diamond" or guide post of a slider which urges the tape ends apart. As a result, it becomes difficult to sew fasteners having such flared tape ends neatly onto a garment or the like.

An improvement has been made in the art such that an open end type of fastener can be held in closed disposition with respective tape ends aligned and straightened by providing a substantially V-shaped opening between the opposed tape ends for receiving the diamond portion of the slider. While this prior fastener device has accomplished the purpose of preventing the tape ends from getting spread or flared, it has encountered a different drawback in that when starting the slider in the fastener opening direction, the diamond of the slider is liable to impringe upon the endmost or the next to the endmost ones of interlocking fastener elements which are still interengaged within the channel of the slider, and this therefore makes the starting movement of the slider sluggish, sometimes difficult.

SUMMARY OF THE INVENTION

According to the invention, there is provided in an open end type of slide fastener comprising a pair of stringer tapes each carrying a row of interlocking fastener elements along one longitudinal edge and a slider having side flanges and a diamond and adapted to open and close the fastener, the improvements comprising an end stop consisting of a pair of lugs formed from a plastic material and secured to the longitudinal edges of the respective stringer tapes, said lugs each having an oblique inner edge extending divergently with respect to the longitudinal axis of the fastener such that said lugs define therebetween a substantially V-shaped opening complementary in shape with the diamond of the slider, and one of said pair of lugs having at least one projection contiguous to said oblique inner edge and the other lug having a recess receiving said projection, said projection extending transversely beyond the central longitudinal axis of the rows of interengaged fastener elements and disposed for abutting engagement with the slider diamond.

It is therefore an object of this invention to provide an improved slide fastener which will eliminate the foregoing difficulties of the prior art devices.

A more specific object of the invention is to provide a slide fastener having a top end stop constructed such that a slider diamond is seated therein and restrained from causing the opposed fastener tapes to spread apart or flare at their respective top ends and further that the slider can start smooth movement in the fastener opening direction.

These and other objects and features of the invention will be more apparent from the following detailed description taken with reference to the accompanying drawings which illustrate by way of example certain preferred embodiments which the invention may assume in practice.

DETAILED DESCRIPTION OF THE PREFERRED EMBODIMENTS

Figure 1:
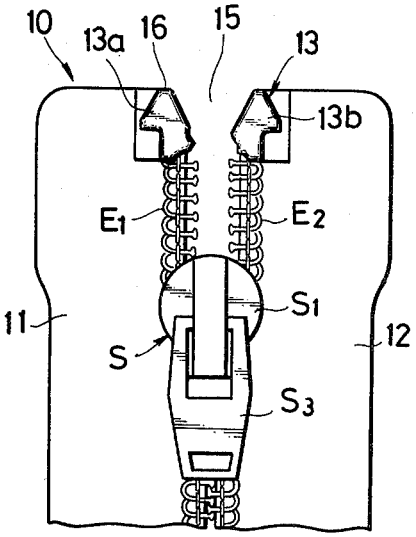
FIG. 1 is a fragmentary plan view of a slide fastener with its top end separated.

Referring now to the drawings and FIG. 1 in particular, there is shown a fragment of a slide fastener generally designated 10 which comprises a pair of stringer tapes 11, 12 each carrying along its inner longitudinal edge a row of interlocking fastener elements $E_1$, ($E_2$) formed from a continuous plastic filament wound into a helical coil structure consisting of convolutions which provide a continuous row of spaced apart interlocking elements.

The opposed rows of elements $E_1$,$E_2$are taken into and out of mutual engagement by a slider S to open and close the fastener 10 in a well known manner. The slider S comprises a body $S_1$, flanges $S_2$ extending downwardly from opposite sides of the body $S_1$, a pull tab $S_3$ pivotally connected to the body $S_1$ for manipulating the slider and a diamond or guide post $S_4$ projectingintermediate the side flanges $S_2$ to define therebetween a substantially Y-shaped channel for the passage of the rows of fastener elements $E_1$, $E_2$. The form and construction of this slider is conventional and hence will require no further description.

In accordance with the invention, there is provided a top end stop 13 comprising a pair of lugs 13*a*, 13*b* formed from a plastic material and secured to respective inner longitudinal edges of the stringer tapes 11,12.

The lugs 13*a*, 13*b* are fused preferably together with extensions of the respective rows of fastener elements $E_1$, $E_2$ to the tape edges so that they can be retained firmly in place against displacement when subjected to external stresses. An inner edge 14 of each of the lugs 13*a*, 13*b* is cut together with the tape fabric obliquely to extend divergently with respect to the longitudinal axis of the fastener, so that when the two opposed lugs 13*a*, 13*b* are brought toward each other, they define therebetween a substantially V-shaped bay or opening 15 complementary in shape with the periphery of the diamond $S_4$ of the slider S, the V-shaped bay 15 thus serving to receive and anchor the diamond $S_4$ therein when the slider S has taken the fastener into fully closed position as better shown in FIG. 3.

Figure 3:
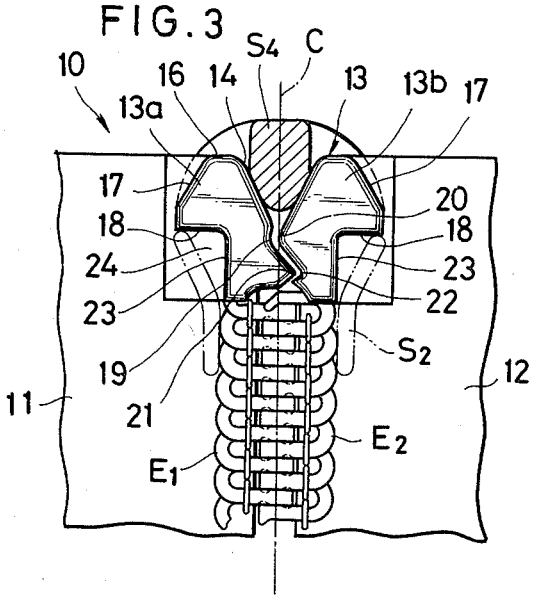
FIG. 3 is a fragmentary plan view of closed top end portion of the fastener with the top slider body cut away to show the relative positions of the slider diamond and a top end stop provided according to the invention.

Each of the lugs 13*a*, 13*b* has an upper marginal edge 16 extending from the oblique inner edge 14 and flush with an extremity of the end of the respective tapes 11, 12, and an outer edge 17 extending obliquely downwardly from the upper marginal edge 16. The lugs 13*a*, 13*b* each have a shoulder 18 merging into the oblique outer edge 17 and extending horizontally for abutting engagement with the upper end of the respective flanges $S_2$ of the slider S when the latter is in the uppermost position as shown in FIG. 3. The inner oblique edge 14 of the lug 13*a* terminates with a first recess 19 and that of the mating lug 13*b* extends a short distance to form a first projection 20 directed toward the recess 19. Contiguous to the first recess 19 of the lug 13*a* is a second projection 21 and contiguous to the first projection 20 of the lug 13*b* is a second recess 22 complementary in contour with the second projection 21.

Extending vertically downwardly from the shoulder 18 of each of the lugs 13*a*, 13*b* is a straight outer edge 23 which defines with the shoulder 18 an offset spacing 24 for facilitating free movement of the flared side flanges $S_2$ of the slider S when closing and opening the fastener 10.

Figure 2:
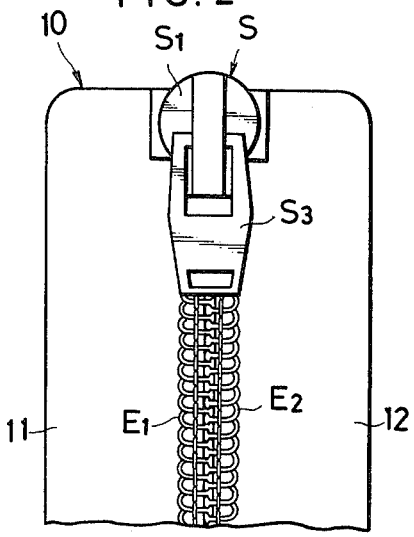
FIG. 2 is a view similar to FIG. 1 but showing the fastener in fully closed disposition.
Figure 7:
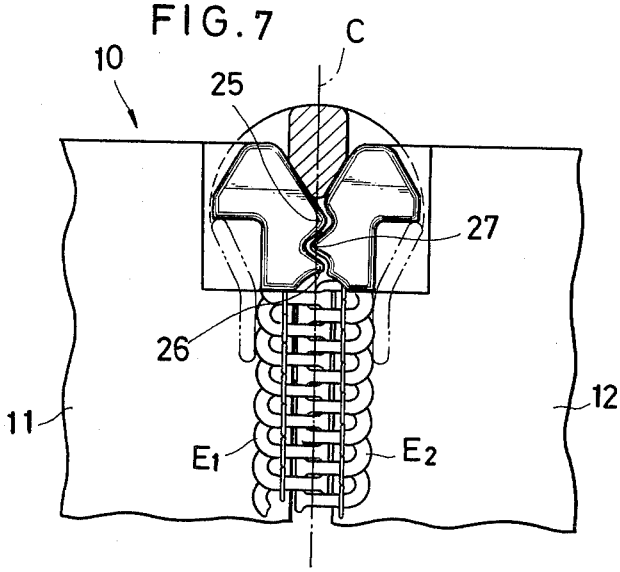
FIG. 7 is a fragmentary plan view of slide fastener according to another embodiment of the invention.

An important aspect of the invention resides in the provision of a plurality of such alternate projections and recesses in each of the lugs 13*a*, 13*b* wherein at least one of the projections, 20, 21 extends transversely beyond a central longitudinal axis C of the rows of fastener elements $E_1$, $E_2$ that are interengaged, so that the diamond $S_4$ of the slider S comes into contact with and urges the end stop 13 to spread apart with this urging pressure transmitted to the endmost ones of elements $E_1$, $E_2$ to disengage the latter in a manner hereafter described. The number of the projections 20, (21) that extends transversely beyond the central longitudinal axis C of the fastener 10 is not limited. For example, as shown in FIG. 7, it is possible to provide two such projections 25, 26 on the lug 13*a* and one projection 27 on the lug 13*b* extending in the space between the projections 25, 26, the arrangement being substantially functionally the same as the first embodiment previously discussed with reference to FIGS. 1–3.

Figure 4:
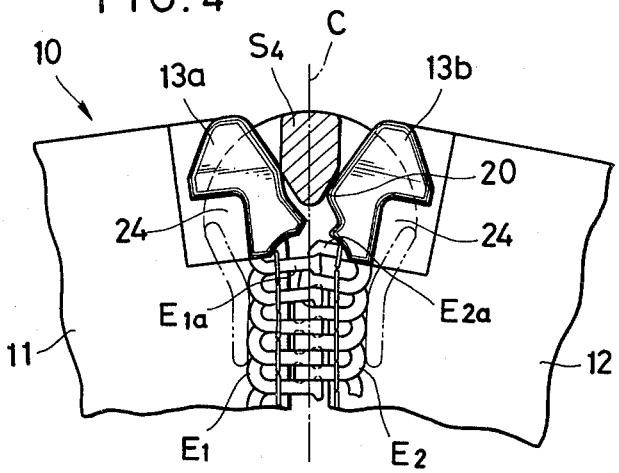
FIGS. 4, 5 and 6 inclusive, are fragmentary plan views of the fastener respectively showing progressive movement of the slider in the fastener opening direction with respect to the top end stop.
Figure 5:
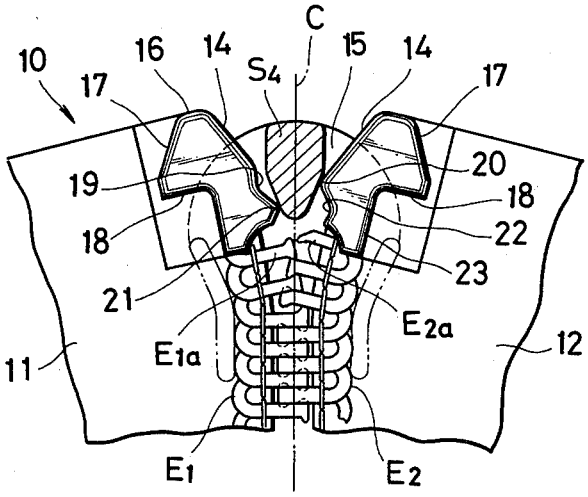
Figure 6:
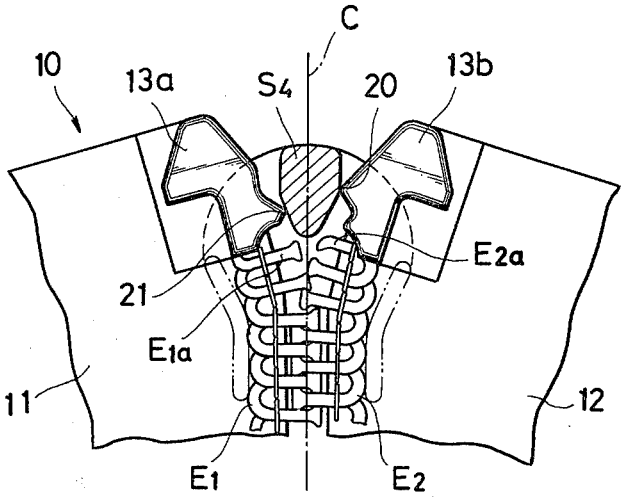

The behaviors of the top end portion of the fastener 10 in response to the operation of the slider S is illustrated in FIGS. 4–6, from which it will be seen that starting downward movement of the slider S in the fastener opening direction from the position of FIG. 3 brings the diamond $S_4$ into abutting engagement with the first projection 20 of the lug 13*b* and urges the two opposed lugs 13*a*, 13*b* spread apart, whereupon the endmost fastener element $E_{2a}$ on one tape 12 begins to move apart from the endmost element $E_{1a}$ on the other tape 11, as shown in FIG. 4.

As the slider S further advances in the fastener opening direction the diamond $S_4$, while being still engaged with the projection 20, now impinges upon the second projection 21 of the lug 13*a* and continues to force apart the opposed lugs 13*a*, 13*b*, the resulting pressure being transmitted to and urging further apart the endmost elements $E_{1a}$, $E_{2a}$, as shown in FIG. 5. FIG. 6 illustrates further advancement of the slider S and concomitant behaviour of the end stop 13 and the endmost elements $E_{1a}$, $E_{2a}$ as well as the ensuing ones of fastener elements $E_1$, $E_2$ that are progressively moved out of mutual engagement.

Various changes and modifications may be made in the precise form and construction of the open end type fasteners herein shown and described, without departing from the scope of the appended claims.

What is claimed is

1. In an open end type of slide fastener comprising a pair of stringer tapes each carrying a row of interlocking fastener elements along one longitudinal edge and a slider having side flanges and a diamond and adapted to open and close the fastener, the improvements comprising an end stop consisting of a pair of lugs formed from a plastic material and secured to the longitudinal edges of the respective stringer tapes, said lugs each having an oblique inner edge extending divergently with respect to the longitudinal axis of the fastener such that said lugs define therebetween a substantially V-shaped opening complementary in shape with the diamond of the slider, and one of said pair of lugs having at least one projection contiguous to said oblique inner edge and the other lug having a recess receiving said projection, said projection extending transversely beyond the central longitudinal axis of the rows of interengaged fastener elements and disposed for abutting engagement with the slider diamond.

2. The improvement as defined in claim 1 wherein said pair of lugs each have a plurality of projections and corresponding recesses, at least one of said projections extending transversely beyond the central longitudinal axis of the rows of interengaged fastener elements.

3. The improvement as defined in claim 1 wherein said lugs each have a horizontally extending shoulder engageable with the side flanges of the slider and a vertically straight outer edge defining with said shoulder an offset spacing.

* * * * *